US009856820B2

(12) United States Patent
Menezes et al.

(10) Patent No.: US 9,856,820 B2
(45) Date of Patent: Jan. 2, 2018

(54) PISTON ASSEMBLY

(75) Inventors: Leandro Menezes, Rochester Hills, MI (US); Dieter Gabriel, Highland, MI (US); Michael T. Lapp, Bloomfield, MI (US); Wolfgang Rein, Milford, MI (US)

(73) Assignee: Mahle International GmbH (DE)

( * ) Notice: Subject to any disclaimer, the term of this patent is extended or adjusted under 35 U.S.C. 154(b) by 413 days.

(21) Appl. No.: 12/898,251

(22) Filed: Oct. 5, 2010

(65) Prior Publication Data

US 2012/0080004 A1 Apr. 5, 2012

(51) Int. Cl.
*F02F 3/00* (2006.01)
*F02F 3/22* (2006.01)

(52) U.S. Cl.
CPC ..... *F02F 3/22* (2013.01); *F02F 3/003* (2013.01); *F02F 2003/0061* (2013.01); *Y10T 29/49254* (2015.01)

(58) Field of Classification Search
CPC ..... F02F 3/00; F02F 3/16; F02F 3/003; F02F 2003/0061; Y10T 29/49254
USPC ..... 123/193.6; 92/186, 231, 220; 29/888.04, 29/888.043
See application file for complete search history.

(56) References Cited

U.S. PATENT DOCUMENTS 908,570 A 1/1909 Howe
2,539,903 A 1/1951 Gruetjen
2,569,103 A 9/1951 Huber
3,189,010 A 6/1965 Isley
3,596,571 A 8/1971 Hill et al.
3,628,511 A 12/1971 Fischer
3,807,014 A 4/1974 Hummel
4,010,718 A 3/1977 Stewart
4,095,513 A 6/1978 Block
4,360,956 A 11/1982 Hiller
(Continued)

FOREIGN PATENT DOCUMENTS

CN 1533860 A 10/2004
CN 1323796 C 7/2007
(Continued)

OTHER PUBLICATIONS

Non-Final OA dated Nov. 2, 2012; U.S. Appl. No. 12/898,300, filed Oct. 5, 2010; PUblication No. US-2011-0197845-A1, Published Aug. 18, 2011.
(Continued)

*Primary Examiner* — Lindsay Low
*Assistant Examiner* — Omar Morales
(74) *Attorney, Agent, or Firm* — Fishman Stewart PLLC

(57) ABSTRACT

Exemplary piston assemblies and methods of making the same are disclosed. An exemplary piston assembly may include a piston crown and a piston skirt that is received in a central opening of the crown. The piston crown may include a ring belt portion defining, at least in part, a cooling gallery. The crown and skirt may each further include corresponding mating surfaces that extend about a periphery of the crown and skirt. The skirt mating surface and crown mating surface may generally be secured to each other that the crown and the skirt cooperate to form a continuous upper combustion bowl surface. The skirt and crown may cooperate to define a radially outer gap about a periphery of the piston crown.

15 Claims, 5 Drawing Sheets

(56) References Cited

U.S. PATENT DOCUMENTS

| | | | | |
|---|---|---|---|---|
| 4,377,967 | A | 3/1983 | Pelizzoni | |
| 4,532,686 | A | 8/1985 | Berchem | |
| 4,553,472 | A | 11/1985 | Munro et al. | |
| 4,581,983 | A | 4/1986 | Moebus | |
| 4,651,631 | A * | 3/1987 | Avezou | B23P 15/10 123/193.6 |
| 4,658,110 | A | 4/1987 | Miller et al. | |
| 4,838,149 | A | 6/1989 | Donnison et al. | |
| 4,870,733 | A | 10/1989 | Kawabata et al. | |
| 4,986,167 | A | 1/1991 | Stratton et al. | |
| 5,081,968 | A | 1/1992 | Bruni | |
| 5,309,818 | A | 5/1994 | Mendes et al. | |
| 5,394,788 | A | 3/1995 | Mendes et al. | |
| 5,650,077 | A | 7/1997 | Zinke | |
| 5,934,174 | A | 8/1999 | Abraham, Sr. et al. | |
| 6,026,777 | A * | 2/2000 | Kemnitz et al. | 123/193.6 |
| 6,112,642 | A | 9/2000 | Jarrett et al. | |
| 6,155,157 | A | 12/2000 | Jarrett | |
| 6,223,701 | B1 | 5/2001 | Kruse | |
| 6,260,472 | B1 | 7/2001 | Zhu et al. | |
| 6,279,455 | B1 | 8/2001 | Kruse | |
| 6,286,414 | B1 * | 9/2001 | Kruse | F02F 3/003 123/193.6 |
| 6,327,962 | B1 | 12/2001 | Kruse | |
| 6,491,013 | B1 | 12/2002 | Gaiser et al. | |
| 6,526,871 | B1 | 3/2003 | Zhu et al. | |
| 6,530,149 | B2 * | 3/2003 | Sugiura | F04B 27/0878 29/888.04 |
| 6,557,514 | B1 * | 5/2003 | Gaiser | 123/193.6 |
| 6,588,320 | B2 | 7/2003 | Gaiser et al. | |
| 6,862,976 | B2 | 3/2005 | Gaiser et al. | |
| 6,892,690 | B2 * | 5/2005 | Gabriel et al. | 123/193.6 |
| 6,910,455 | B2 * | 6/2005 | Sczepanski | F02B 23/104 123/193.6 |
| 6,990,890 | B2 | 1/2006 | Zhu et al. | |
| 7,131,418 | B2 * | 11/2006 | Wieland | F02F 3/22 123/193.6 |
| 7,143,685 | B2 | 12/2006 | Zhu et al. | |
| 7,578,229 | B2 * | 8/2009 | Dye | B21K 1/18 29/888.042 |
| 7,584,694 | B2 * | 9/2009 | Scharp | 92/221 |
| 2002/0189442 | A1 | 12/2002 | Zhu et al. | |
| 2003/0037671 | A1 | 2/2003 | Zhu et al. | |
| 2004/0149739 | A1 | 8/2004 | Ribeiro et al. | |
| 2004/0177503 | A1 | 9/2004 | Bing et al. | |
| 2004/0177505 | A1 | 9/2004 | Bing et al. | |
| 2006/0027424 | A1 | 2/2006 | Jahkonen | |
| 2006/0207424 | A1 * | 9/2006 | Gaiser | 92/222 |
| 2007/0048156 | A1 | 3/2007 | Chung et al. | |
| 2007/0079775 | A1 | 4/2007 | Lin et al. | |
| 2007/0283917 | A1 * | 12/2007 | Lapp | F02F 3/003 123/193.6 |
| 2007/0295299 | A1 * | 12/2007 | Lapp et al. | 123/193.6 |
| 2008/0041333 | A1 | 2/2008 | Jarrett et al. | |
| 2008/0209725 | A1 | 9/2008 | Sander | |
| 2008/0229923 | A1 | 9/2008 | Gniesmer et al. | |
| 2008/0250640 | A1 | 10/2008 | Reichstein et al. | |
| 2009/0002007 | A1 | 1/2009 | Schubring et al. | |
| 2009/0151555 | A1 | 6/2009 | Lapp et al. | |
| 2009/0158925 | A1 | 6/2009 | Scharp | |
| 2009/0194059 | A1 * | 8/2009 | Grahle | F02F 3/003 123/193.6 |
| 2009/0241769 | A1 | 10/2009 | Feeser | |
| 2010/0010527 | A1 | 1/2010 | Chen | |
| 2010/0108001 | A1 | 5/2010 | Scharp et al. | |
| 2010/0218673 | A1 | 9/2010 | Ribeiro | |
| 2010/0275861 | A1 | 11/2010 | Schneider | |
| 2010/0275873 | A1 | 11/2010 | Gniesmer et al. | |
| 2010/0299922 | A1 | 12/2010 | Gniesmer et al. | |
| 2010/0301567 | A1 | 12/2010 | Schmitt | |
| 2010/0307445 | A1 | 12/2010 | Kortas et al. | |
| 2011/0030645 | A1 | 2/2011 | Rebello et al. | |
| 2011/0107997 | A1 | 5/2011 | Muscas et al. | |
| 2011/0119914 | A1 | 5/2011 | Janssen et al. | |
| 2011/0126702 | A1 | 6/2011 | Malm et al. | |
| 2011/0167632 | A1 | 7/2011 | Fedyna et al. | |
| 2011/0197845 | A1 | 8/2011 | Flowers et al. | |
| 2011/0265326 | A1 | 11/2011 | Lin et al. | |
| 2012/0037112 | A1 | 2/2012 | Muscas | |
| 2012/0080004 | A1 | 4/2012 | Menezes et al. | |

FOREIGN PATENT DOCUMENTS

| | | | |
|---|---|---|---|
| CN | 101468426 | A | 7/2009 |
| DE | 1024512 | B | 2/1958 |
| DE | 2537182 | A1 | 3/1977 |
| DE | 2717084 | A1 | 10/1978 |
| DE | 2730120 | A1 | 1/1979 |
| DE | 142372 | | 3/1979 |
| DE | 2919638 | A1 | 11/1980 |
| DE | 3032671 | A1 | 3/1982 |
| DE | 142372 | T1 | 1/1986 |
| DE | 3523910 | A1 | 1/1986 |
| DE | 3719703 | A1 | 12/1988 |
| DE | 4134528 | A1 | 5/1992 |
| DE | 4129746 | A1 | 4/1993 |
| DE | 29905633 | U1 | 8/2000 |
| DE | 10042207 | A1 | 3/2002 |
| DE | 10128737 | A1 | 1/2003 |
| DE | 10145589 | A1 | 4/2003 |
| DE | 102004038464 | A1 | 2/2006 |
| DE | 102004061778 | A1 | 4/2006 |
| DE | 102006021044 | A1 | 11/2007 |
| EP | 0019323 | A1 | 11/1980 |
| EP | 0464626 | A1 | 1/1992 |
| EP | 0787898 | A1 | 8/1997 |
| EP | 0877160 | A1 | 11/1998 |
| EP | 1084793 | A1 | 3/2001 |
| EP | 1611975 | A1 | 1/2006 |
| EP | 1614885 | A2 | 1/2006 |
| EP | 1878902 | A2 | 1/2008 |
| FR | 2668090 | A1 | 4/1992 |
| FR | 2918118 | A1 | 1/2009 |
| GB | 1092720 | A | 11/1967 |
| GB | 1111225 | A | 4/1968 |
| GB | 1265820 | A | 3/1972 |
| GB | 1501387 | A | 2/1978 |
| GB | 2035448 | A | 6/1980 |
| GB | 2431218 | A | 4/2007 |
| JP | 60166158 | U | 11/1985 |
| JP | 1178756 | A | 7/1989 |
| SU | 1518562 | A1 | 10/1989 |
| WO | WO-8302300 | A1 | 7/1983 |
| WO | WO-0220971 | A1 | 3/2002 |
| WO | WO-2006060987 | A1 | 6/2006 |
| WO | WO-2007/082564 | A1 | 7/2007 |
| WO | WO-2009106200 | A1 | 9/2009 |
| WO | WO-2010009779 | A1 | 1/2010 |
| WO | WO-2010/075959 | A1 | 7/2010 |

OTHER PUBLICATIONS

International Search Report for PCT/EP2011/004956.
English abstract provided for FR-2918118.
English abstract provided for DE-10128737.

* cited by examiner

PISTON ASSEMBLY

BACKGROUND

Internal combustion engine manufacturers are constantly seeking to increase power output and fuel efficiency of their products. One method of generally increasing efficiency and power is to reduce the oscillating mass of an engine, e.g., of the pistons, connecting rods, and other moving parts of the engine. Engine power may also be increased by raising the compression ratio of the engine. Raising the compression ratio of an engine also generally raises the pressure and temperature within the combustion chamber during operation.

Engines, and in particular the pistons of the engine, are therefore under increased stress as a result of these reductions in weight and increased pressures and temperatures associated with engine operation. Piston cooling is therefore increasingly important for withstanding the increased stress of such operational conditions over the life of the engine.

To reduce the operating temperatures of piston components, a cooling gallery may be provided about a perimeter of the piston. A coolant such as crankcase oil may be introduced to the cooling gallery, and may be distributed about the cooling gallery by the reciprocating motion of the piston, thereby reducing the operating temperature of the piston.

At the same time, the cooling galleries may increase overall complexity of the piston assembly. For example, cooling galleries may require additional component, such as cooling gallery covers, in order to encourage proper circulation of a coolant throughout the cooling gallery. A cooling gallery may rely on a cover plate fitted to the piston crown that generally traps coolant (e.g., oil) within the cooling gallery, thereby increasing the cooling effect of the gallery. The additional components also add complexity, however. Additionally, cooling galleries may be expensive and/or difficult to form in smaller piston applications such as in the case of lightweight or light duty pistons.

Accordingly, there is a need for a piston that minimizes overall piston weight and manufacturing complexity, while also allowing adequate cooling, such as by providing a cooling gallery.

BRIEF DESCRIPTION OF THE DRAWINGS

While the claims are not limited to the illustrated examples, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows:

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein of a piston assembly and a method of making such an assembly. An exemplary piston assembly may include a piston crown and a piston skirt that is received in a central opening of the crown. The piston crown may include a ring belt portion defining, at least in part, a cooling gallery. The crown and skirt may each further include corresponding mating surfaces that extend about a periphery of the crown and skirt. The skirt mating surface and crown mating surface may generally be secured to each other that the crown and the skirt cooperate to form a continuous upper combustion bowl surface. The skirt and crown may cooperate to define a radially outer gap about a periphery of the piston crown.

Exemplary methods of making a piston assembly may include providing a piston crown that includes a ring belt portion defining at least in part a cooling gallery. An exemplary method may further include receiving a piston skirt in a central opening of the crown such that the crown and skirt cooperate to form a continuous upper combustion bowl surface. An exemplary method may further include securing the skirt to the crown along corresponding mating surfaces of the skirt and crown. The skirt and crown may generally cooperate to define a radially outer gap about a periphery of the piston crown.

Figure 1:
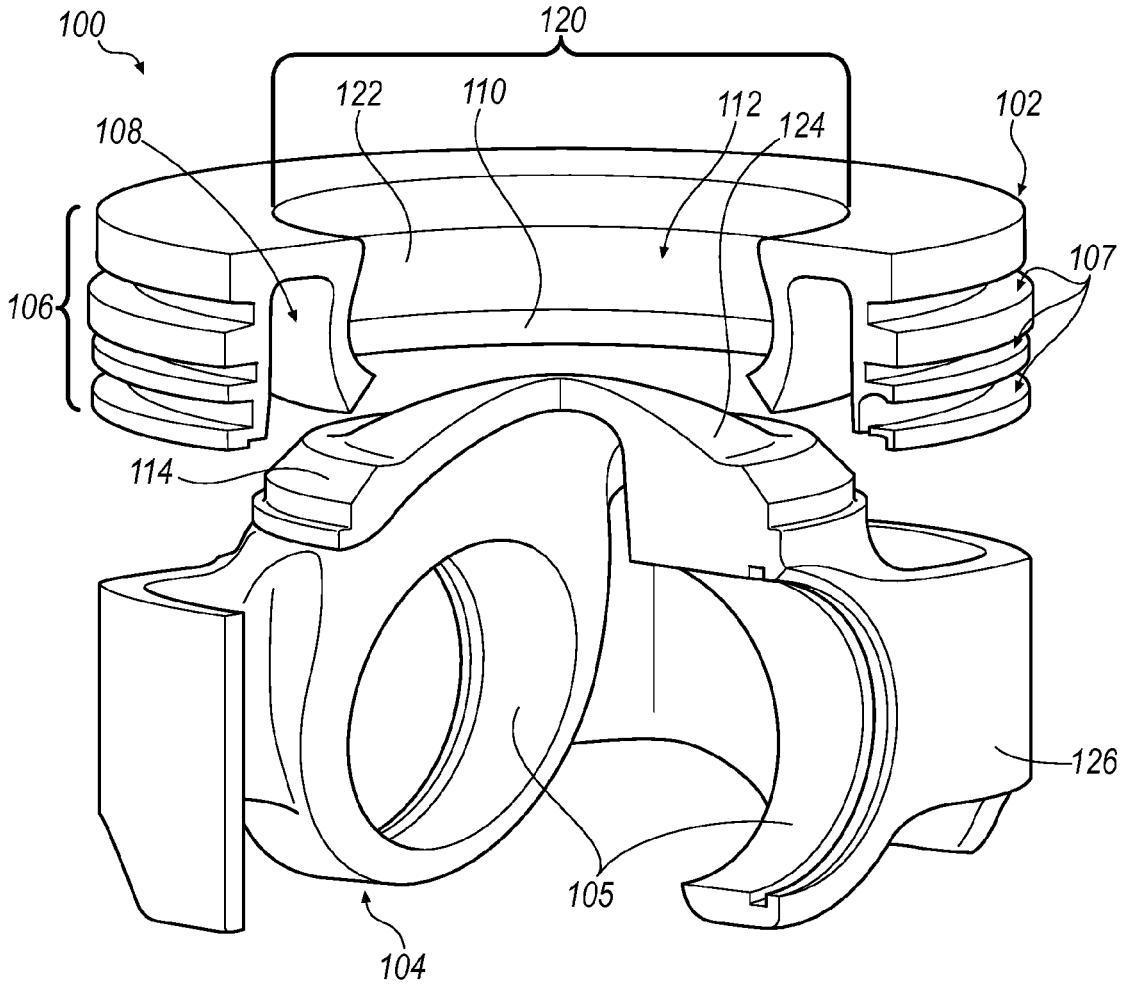
FIG. 1 is a perspective view of an exemplary piston assembly.
Figure 2A:
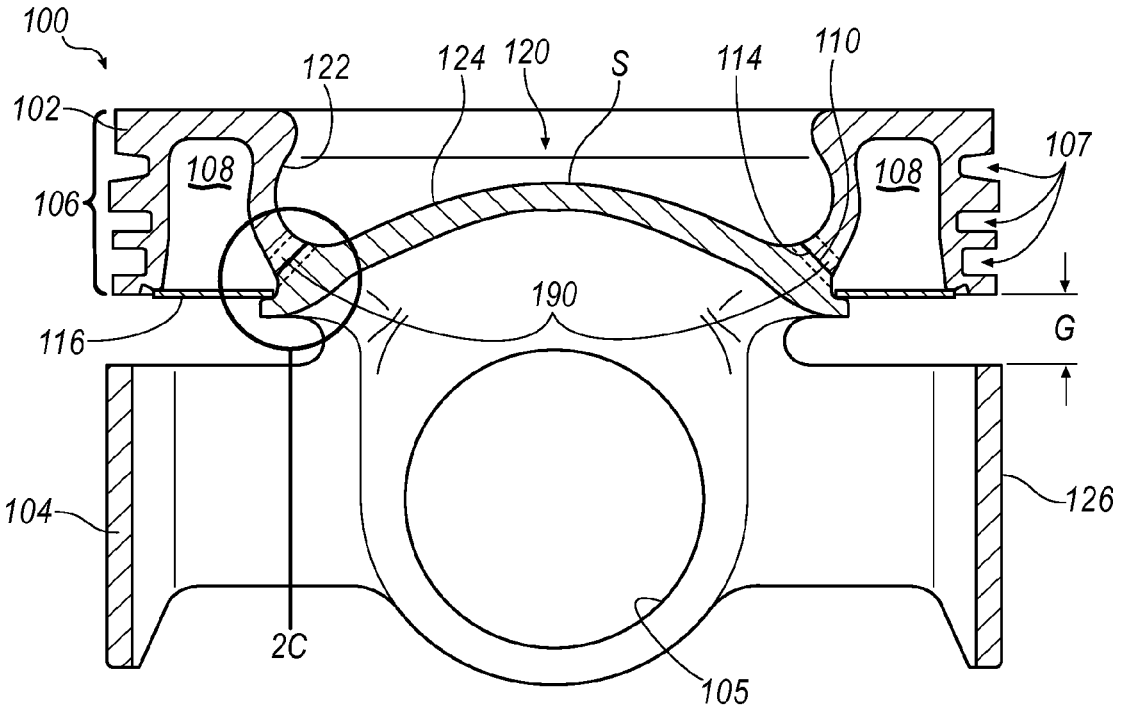
FIG. 2A is a partial section view of an exemplary piston assembly.
Figure 2B:
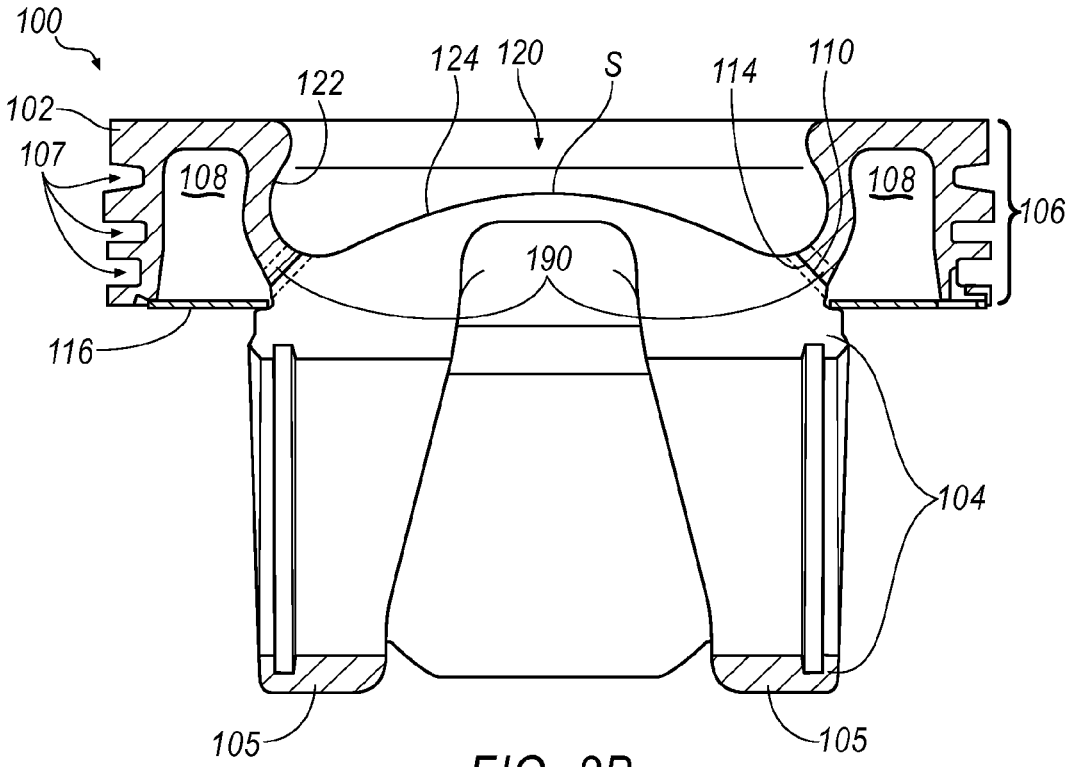
FIG. 2B is a partial section view of an exemplary piston assembly, with the section taken through the piston pin bore.

Turning now to FIGS. 1, 2A, 2B, an exemplary piston assembly 100 is illustrated. Piston assembly 100 may include a piston crown 102 and a piston skirt 104 that is received in a central opening 112 of the crown 102. The piston crown 102 and skirt 104 may thereby define a combustion bowl 120. The crown 102 may include a ring belt portion 106 that is configured to seal against an engine bore (not shown) receiving the piston assembly 100. For example, the ring belt portion 106 may define one or more circumferential grooves 107 that receive piston rings (not shown), which in turn seal against engine bore surfaces during reciprocal motion of the piston assembly 100 within the engine bore. Receipt of the skirt 104 within the crown 102 may allow flexibility in regard to the size and shape of the crown 102 and/or the piston assembly 100, e.g., allowing a lower overall crown height and/or center of gravity of the piston assembly 100.

The piston skirt 104 generally supports the crown 102 during engine operation, e.g., by interfacing with surfaces of an engine bore (not shown) to stabilize the piston assembly 100 during reciprocal motion within the bore. For example, the skirt 104 may have an outer surface 126 that generally defines a circular outer shape about at least a portion of a perimeter of the piston assembly 100. The outer shape may correspond to the engine bore surfaces, which may be generally cylindrical. The circular skirt surfaces 126 may generally slide along the bore surfaces as the piston moves reciprocally within the bore. The skirt 104 may be formed in any manner that is convenient, e.g., forging, cold forming, machining, or the like.

The skirt 104 may also define piston pin bosses 105. The piston pin bosses 105 may generally be formed with apertures configured to receive a piston pin (not shown). For example, a piston pin may be inserted through the apertures in the piston pin bosses 105, thereby generally securing the skirt 104 to a contacting rod (not shown).

The ring belt portion 106 of the crown 102 may define, at least in part, a cooling gallery 108, as best seen in FIGS. 2A and 2B. The cooling gallery 108 generally extends about a perimeter of the piston crown, and may circulate a coolant during operation, e.g., engine oil, thereby reducing an operating temperature of the piston. Additionally, the circulation of the coolant may facilitate the maintaining of a more stable or uniform temperature about the piston 100, and especially in the upper portion of the piston assembly 100, e.g., the crown 102 and combustion bowl 120.

The cooling gallery 108 may be generally enclosed entirely within the crown 102. For example, the cooling gallery 108 may be enclosed by a cooling gallery cover plate 116 (as shown in FIG. 2A and FIG. 2B, but not in FIG. 1). More specifically, the cover plate 116 may form a lower boundary of the cooling gallery 108, thereby enclosing the cooling gallery 108 within the crown 102, and preventing coolant from freely entering and escaping the cooling gallery 108. At the same time, one or more inlets (not shown) and/or outlets (not shown) may also be provided to allow oil or other coolants to be circulated throughout the cooling gallery 108 to/from the engine (not shown) in a controlled manner, thereby reducing and/or stabilizing operating temperatures associated with the piston 100 and components thereof.

As best seen in FIG. 2A, a circumferential gap G is provided between the crown 102 and the skirt 104. As further described below, the gap G generally allows access to the cooling gallery 108 after the crown 102 and skirt 104 are secured to one another, e.g., for any finishing operations, e.g., machining, and/or installation of the cover plate 116. In one illustration, the gap is between approximately 8 millimeters and approximately 15 millimeters. Such a gap may generally allow adequate space for insertion and/or assembly of the cover plate 116 to the gallery 108 after a welding operation, as will be further described below.

By fixedly joining the piston crown 102 and the piston skirt 104, the piston assembly 100 is generally formed as a one-piece or "monobloc" assembly. As will be described further below, the crown 102 and skirt 104 components may be joined at the mating surfaces 110, 114, and the mating surfaces 110, 114 may form the sole connection between the crown 102 and skirt 104. In one exemplary illustration, an interface region 190, as best seen in FIGS. 2A and 2B, includes the mating surfaces 110, 114. Accordingly, the piston crown 102 may be generally unitized with the piston skirt 104, such that the piston skirt 104 is immovable relative to the piston crown 102 after securement to the crown, although the crown 102 and skirt 104 are separate components.

The piston crown 102 and piston skirt 104 may be constructed from any materials that are convenient. In one exemplary illustration, the crown 102 and skirt 104 are formed of the same material, e.g., steel. In another example, the piston crown 102 may be formed of a different material than the piston skirt 104. Accordingly, a material used for the piston crown 102 may include different mechanical properties, e.g., yield point, tensile strength or notch toughness, than the piston skirt 104. Any material or combination may be employed for the crown 102 and skirt 104 that is convenient. Merely as examples, the crown 102 and/or skirt 104 may be formed of a steel material, cast iron, aluminum material, composite, or powdered metal material. The crown 102 and skirt 104 may also be formed in different processes, e.g., the crown 102 may be a generally single cast piece, while the skirt 104 may be forged. Any material and/or forming combination may be employed that is convenient.

The crown 102 and skirt 104 may be secured to each other in any manner that is convenient. In one exemplary illustration, the crown 102 and the skirt 104 may define corresponding mating surfaces that extend about a circumference of the crown 102 and skirt 104, respectively. More specifically, the crown 102 may define a crown mating surface 110 that generally extends about a periphery of the crown 102. As best seen in FIGS. 1, 2A, 2B, and 2C, the crown mating surface 110 may define a generally flat surface, at least when viewed in section as in FIGS. 2A and 2B, that aligns with a corresponding mating surface 114 of the piston skirt 104. As will be described further below, the skirt mating surface 114 and crown mating surface 110 may be aligned generally parallel to allow the surfaces 110, 114 to be placed in abutment with each other. The mating surfaces 110, 114 may be secured to each other such as by way of a welding operation or adhesive bonding, merely as examples, thereby securing the crown 102 and skirt 104 together.

Figure 2C:
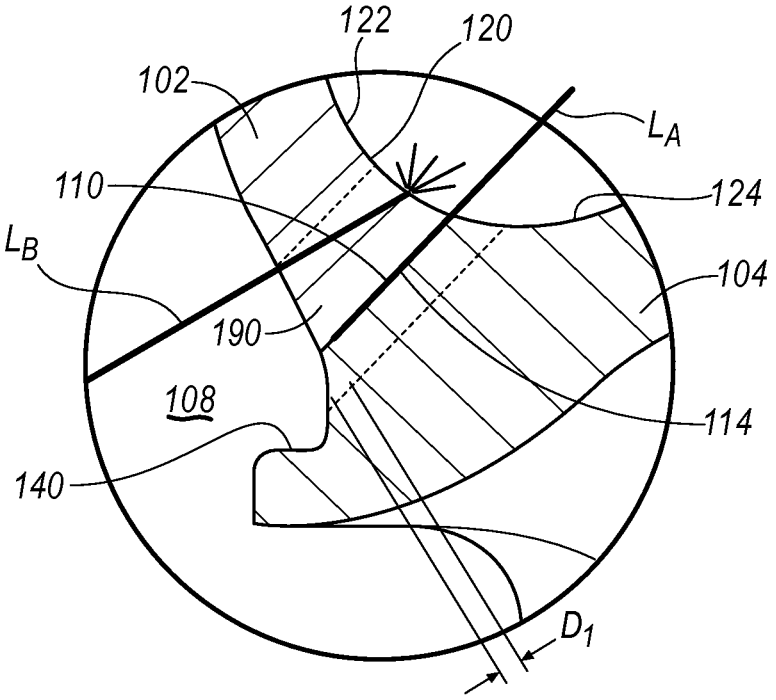
FIG. 2C is a magnified view of the sectional view of FIG. 2A.

The skirt 104 may secured to the crown 102 such that the crown 102 and the skirt 104 cooperate to form a continuous upper combustion bowl surface S in the combustion bowl area 120 of the piston assembly 100. For example, as best shown in FIGS. 2A, 2B and 2C, the corresponding mating surfaces 110 and 114 meet within the combustion bowl 120 such that the crown 102 defines a first radially outer portion 122 of the combustion bowl surface S. Further, the skirt 104 defines a radially inner portion 124 of the combustion bowl surface S.

The combustion bowl surface S may be substantially smooth across an interface between the skirt 104 and the crown 102, e.g., so that disruptions and/or discontinuities in the surface S are minimized. Minimizing such disruptions or discontinuities may generally reduce cracks or other loosening of an interface between the crown 102 and the skirt 104 along the mating surfaces 110 and 114 during normal long-term operation. Accordingly, any defects or failure in the combustion bowl surface S, e.g., due to wear occurring during operation of an engine using piston assembly 100, may be minimized. As will be described further below, welding and/or machining operations used in the formation of piston assembly 100 may reduce surface irregularities in the combustion bowl surface S.

The piston crown 102 and the piston skirt 104 may be secured or fixedly joined to one another in any manner that is convenient including, but not limited to, welding methodologies such as beam welding, laser welding, soldering, or non-welding methodologies such as adhesive bonding, merely as examples. In one example, the piston crown and skirt are joined in a welding process, e.g., laser welding, that allows the weld tool to form a generally smooth combustion bowl surface 120 using minimal machining operations before and/or after a welding process associated with joining the crown 102 and the skirt 104.

A laser welding operation may generally allow the formation of a solid metallic weld between the crown 102 and the skirt 104 while also minimizing the size of an associated heat affected zone. More specifically, as best seen in FIGS. 2A and 2B an interface region 190 including the mating surfaces 110, 114 may be operated upon by a weld tool, thereby joining the crown 102 and skirt 104 at the interface region 190. In one exemplary illustration, a weld laser is employed having a wavelength between approximately 200 and approximately 400 μm. A weld laser may generally be employed to propagate a heat affected zone in the interface region 190, which may includes or be directly adjacent the mating surfaces 110 and 114 such that the mating surfaces 110, 114 are included in the associated heat affected zone of the weld. The crown 102 and skirt 104 may be thereby welded together about the mating surfaces 110, 114. In one exemplary illustration, a series of welds are made along the circumferential extent of the mating surfaces 110, 114. In another exemplary illustration, a weld laser is used in a generally continuous welding process that extends substantially about the entire circumference of the mating surfaces 110, 114, such that the weld extends substantially about the entire crown 102 and skirt 104.

A laser weld operation may be performed in any manner that is convenient. Two exemplary illustrations are illustrated in FIG. 2C. According to one illustration, a weld laser $L_A$ may be directed toward the mating surfaces 110, 114 from a radially inner position with respect to the piston assembly 100. For example, laser $L_A$ may be directed from combustion bowl area 120 radially outward toward the mating surfaces 110 and 114. The weld zone may generally encompass both mating surfaces 110, 114, thereby welding each together. In other words, the laser $L_A$ may be directed such that the heat affected zone propagated by the laser joins the crown 102 and skirt 104 together. While the laser LA may be directed generally parallel to the generally flat mating surfaces 110, 114, as best seen in FIGS. 2A and 2B, any angle may be employed that is sufficient to create the heat affected zone with the interface region 190, including at least each of the mating surfaces 110, 114 to join the crown 102 and skirt 104. As will be described further below, laser $L_A$ may be of a power such that the laser $L_A$ does not fully penetrate a joint depth, and any weld spatter is thereby reduced or eliminated entirely.

In an alternative exemplary illustration shown in FIG. 2C, a weld laser $L_B$ may be directed radially inwardly toward the mating surfaces 110, 114. More specifically, weld laser $L_B$ may be propagated from a position radially outward of the piston assembly 100 and may be directed toward the mating surfaces 110, 114. As described further below, laser $L_B$ may be of a power such that the laser $L_B$ penetrates an entire joint depth associated with the mating surfaces 110, 114, and some weld spatter may thereby be produced on the opposing surface, within the combustion bowl 120.

Weld lasers $L_A$, $L_B$ may be directed toward the mating surfaces 110, 114 at a penetration depth that may be generally equal to or less than a joint depth associated with the mating surfaces 110 and 114. For example, as shown in FIG. 2C, weld laser $L_A$ is directed toward mating surfaces 110, 114 at a weld depth that is less than the overall joint depth associated with the mating surfaces 110 and 114. In other words, as seen in FIG. 2C a gap $D_1$ is provided between the maximum penetration depth associated with the laser $L_A$ and the opposite surface of the joint, which forms a boundary of the cooling gallery 108. Accordingly, the weld generally does not extend entirely through the joint between the mating surfaces 110, 114. Further, this also may reduce or eliminate entirely any weld spatter or other surface discontinuities in the cooling gallery 108, or for a seating surface 140 associated with the radially inner portion of the cover plate 116 (not shown in FIG. 2C). The seating surface 140 may thereby be left relatively smooth, minimizing any need for further machining of the cooling gallery 108 surfaces after the welding operation. In one exemplary illustration, the gap $D_1$ is approximately 1 millimeter. In this illustration, the approximately 1 millimeter gap generally maximizes the amount of material affected by the weld and joined. At the same time, the gap also may be adequate to prevent weld spatter from accumulating on an opposite side of the joint, e.g., adjacent seating surface 140.

Alternatively, weld laser $L_B$ is shown penetrating the entire joint depth, resulting in at least some small amount of weld splatter on the opposite side of the weld joint, i.e., along the combustion bowl surface 120. While it may be generally desirable to minimize an overall amount of weld spatter or other surface discontinuities caused by a welding operation, in some illustrations some amount of weld spatter may be permissible. For example, the combustion bowl surface 120 may be generally easily accessed by machining tools after the welding operation to facilitate removal of any spatter. By contrast, weld spatter may be less easily removed within the relatively confined space of the cooling gallery 108, and therefore it may be more desirable to more closely control penetration depth of a laser, e.g., laser $L_A$, when directed radially outwardly.

Additionally, any need for finish machining processes after the welding operation may be reduced by pre-machining of the piston assembly 100, e.g., about the cooling gallery 108 and skirt 104, before the welding operation. For example, generally precise forming of the crown 102 and skirt 104 prior to joining the crown 102 and skirt 104 may minimize the need for cleanup of material flash, weld spatter, or other discontinuities that may result from the various forming and securing operations that may be employed. Accordingly, any necessary finishing machining operations after the welding of the skirt 104 and the crown 102 may be reduced in complexity, extent, and/or cost.

Figure 3:
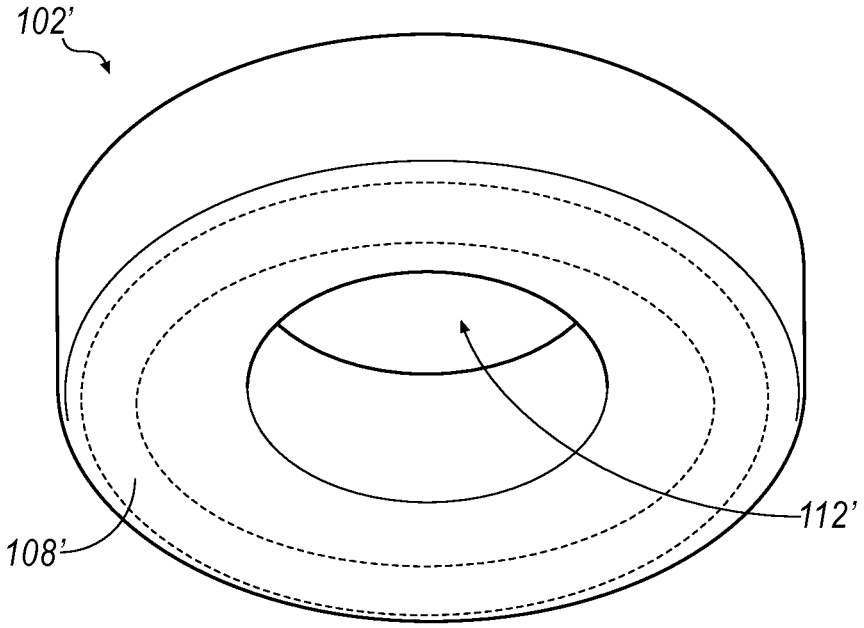
FIG. 3 is a perspective view of an exemplary piston crown blank.
Figure 4A:
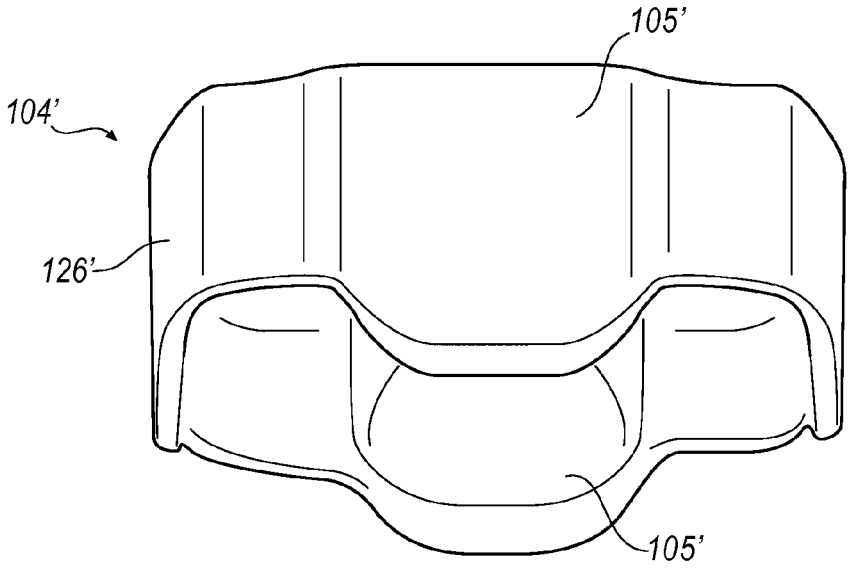
FIG. 4A is a lower perspective view of an exemplary piston skirt blank.
Figure 4B:
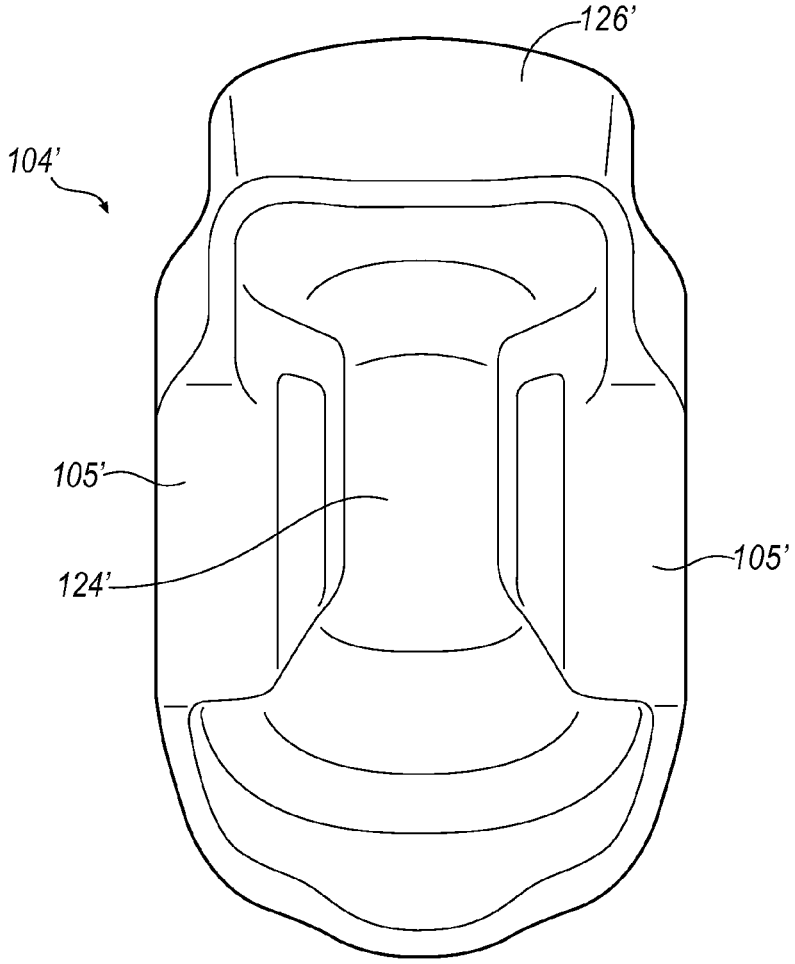
FIG. 4B is an upper perspective view of the exemplary piston skirt blank of FIG. 4A.

Turning now to FIGS. 3, 4A, and 4B, exemplary components of the piston assembly 100 that may reduce the need for post-securement machining operations are shown. More specifically, FIG. 3 illustrates a piston crown blank 102'. The piston crown blank 102' may be initially cast or machined. The piston crown blank 102' generally defines a doughnut shape having a preformed central aperture 112'. Further, the cooling gallery 108 may be preformed in the piston crown blank 102'. For example, a depression 108' or other precursor of the completed gallery 108 may be provided in the piston crown blank 102'. The piston crown blank 102' may be formed from the initial doughnut shape into the final shape of the piston crown 102 using any forming process that is convenient, e.g., forging, cold forging, machining, or the like. The initial "doughnut" shape of the crown blank 102' may generally minimize the need for extensive forming operations to complete the crown 102, e.g., forging or machining.

Turning now to FIGS. 4A and 4B, a piston skirt blank 104' is shown that may be used to form the piston skirt 104. The skirt blank 104' may initially be formed in any manner that is convenient, e.g., forging and/or machining. As shown in FIGS. 4A and 4B, the piston skirt blank 104' includes pin boss extensions 105' on either side of the skirt blank 104'.

The pin boss extensions 105' are ultimately formed into the pin bosses 105, e.g., by way of a forging operation. Additionally, a top side of the piston skirt blank 104' may generally define a radially inner extension 124' that is ultimately formed into the radially inner portion 124 of the combustion bowl surface S. The piston skirt blank 104' may also define an outer surface 126' that is ultimately formed into the generally circular outer surface 126 of the piston skirt 104. The skirt blank 104' may be generally simplified in complexity and reduced in weight, at least in part, by eliminating extra material required to form cooling gallery features, e.g., a cover plate integral with the skirt 104.

Figure 5A:
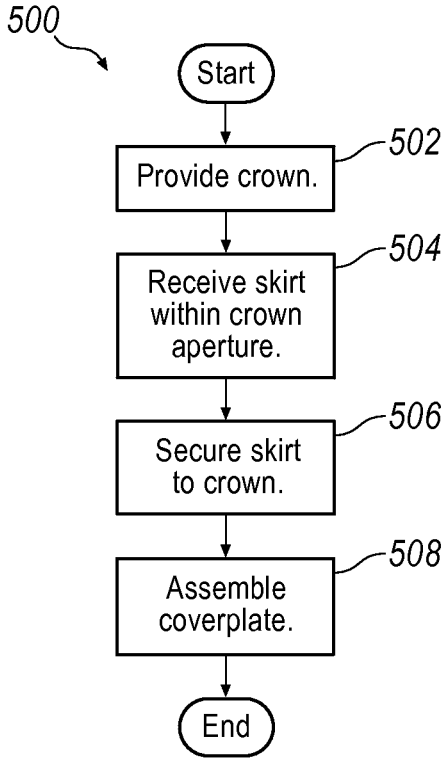
FIG. 5A is a process flow diagram of an exemplary method of assembling a piston.
Figure 5B:
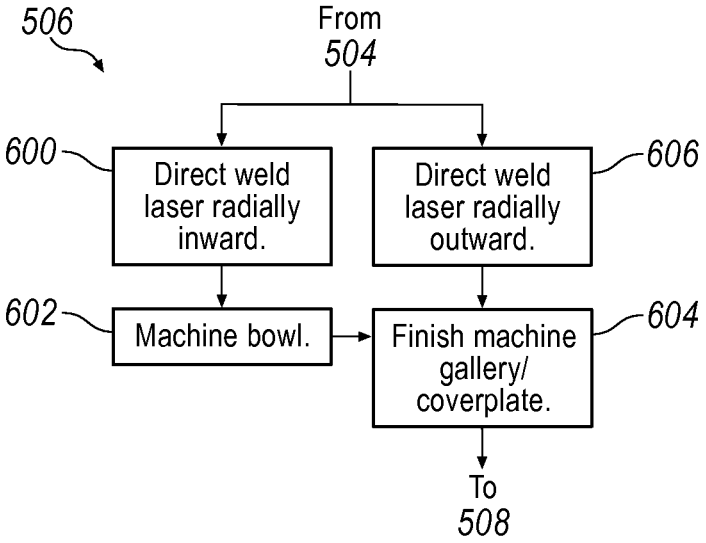
FIG. 5B is an exemplary process flow diagram of an exemplary sub-process of securing a piston crown to a piston skirt.

Turning now to FIGS. 5A and 5B, an exemplary of method of assembling a piston will be described. Process 500 may generally begin at block 502, where a piston crown is provided. For example, as described above, a piston crown 102 may be provided that includes a ring belt portion 106 defining, at least in part, a cooling gallery 108.

As mentioned above, piston crown 102 may be formed in any process that is convenient. In one exemplary illustration, piston crown 102 is formed from a piston crown blank 102'. For example, the piston crown 102 may be formed from piston crown blank 102' in a cold forming process that allows the finished piston crown 102 to be work hardened, and thereby strengthened by the cold forming process. Further, as described above, the piston crown blank 102' may generally define a central aperture 112' that is eventually formed into central opening 112 of the piston crown 102. The provision of a central aperture 112' may thereby reduce or eliminate any need for operations for removing material from the center of the piston blank 102', e.g., punching. Process 500 may then proceed to block 504.

At block 504, a piston skirt may be received within a central opening of the crown. For example, as described above, a piston skirt 104 may be provided that is received within central opening 112 of the piston crown 102. Further, the crown 102 and skirt 104 may generally cooperate to form a continuous upper combustion bowl surface S after the skirt 104 is received within the crown 102. As mentioned above, the skirt 104 may be formed in any manner that is convenient, e.g., forging, cold forming, etc.

Upon receipt of the skirt 104 within the opening 112 of the crown 102, the corresponding mating surfaces 110, 114 may generally be abutted within the combustion bowl 120. For example, as described above the crown 102 may define a radially outer portion of the combustion bowl surface S, while the skirt 104 defines a radially inner portion of the combustion bowl surface S. Further, the skirt 104 and crown 102 may cooperate to define a radially outer gap G that extends about a periphery of the piston crown 102. Process 500 may then proceed to block 506.

At block 506, the crown 102 may be secured to the skirt 104 along the corresponding mating surfaces 110, 114. In one exemplary illustration, the corresponding mating surfaces 110, 114 may generally define the sole connection between the crown 102 and the skirt 104, thereby simplifying assembly of the piston assembly 100. As noted above the crown 102 and skirt 104 may be secured to each other in any manner that is convenient. For example the skirt and crown may be joined in a welding operation, e.g., laser welding.

Turning now to FIG. 5B, an exemplary laser weld process is illustrated. For example, in block 600, a weld laser $L_A$ may be directed toward the mating surfaces 110, 114 radially outwardly, i.e., from a radially inner position with respect to the mating surfaces 110, 114. Alternatively, at block 606 a weld laser, e.g., laser $L_B$, may be directed radially inwardly toward the mating surfaces 110, 114 from a radially outer position with respect to the mating surfaces 110, 114. Under other circumstances it may be desirable to use both or other processes at the same time.

As also noted above, one or more weld lasers may be directed toward the mating surfaces 110, 114 at a penetration depth that may be equal to or less than a joint depth associated with the mating surfaces 110 and 114. For example, weld laser $L_A$ described above forms a weld that generally does not extend entirely through the joint depth along the mating surfaces 110, 114. This may advantageously reduce or eliminate entirely any weld spatter or other surface discontinuities in the cooling gallery 108 and/or the seating surface 140 of the cover plate 116 (not shown in FIG. 2C). Alternatively, a weld laser, e.g., laser $L_B$, may penetrate through the entire joint, resulting in at least some small amount of weld splatter on the opposite side of the weld joint.

As generally described above, penetrating an entire weld joint may create more weld spatter, and thus require some additional post-welding cleanup operations such as machining. However, penetration of the entire weld joint may also result in increased strength of the joint between the two materials. Further, a remaining "seam" formed by the mating surfaces 110, 114 may be more permissible where the seam is positioned away from the combustion bowl surface S, where temperatures and/or pressures may be greatest during piston operation. Accordingly, the weld may be optimized for a given application depending on whether greater strength or minimal post-welding machining is a greater priority.

Accordingly, in the exemplary illustration of FIG. 5B, where the weld is directed radially inwardly at block 600, it may subsequently be necessary to machine the combustion bowl surface S at block 602. This additional step (block 602) may not be necessary where the weld is directed radially outwardly, e.g., at block 606.

Upon completion of the weld in block 606 or the bowl machining in block 602, a finish machining operation may be employed in block 606 to complete any necessary features in the cooling gallery 108 and/or adjacent the cover plate 116 to allow installation of the cover plate 116. For example, minor machining operations may be applied to the piston assembly 100 upon completion of the welding operations to remove surface imperfections or otherwise complete final assembly of the piston assembly 100. For example, inclusions about a weld zone associated with a laser welding operation may be removed by a machining operation. In one exemplary illustration, a machining operation may be used to remove inclusions caused by the welding operation while also finishing the seating surface 140 used to retain the cover plate 116 to enclose the cooling gallery 108.

Any need for finish machining processes after the welding operation may be reduced by pre-machining of the piston assembly 100, e.g., about the cooling gallery 108 and skirt 104, before the welding operation. For example, generally precise forming of the crown 102 and skirt 104 prior to joining the crown 102 and skirt 104 together may minimize the need for cleanup of material flash, weld spatter, or other surface discontinuities that may result from the various forming and securing operations that may be employed. Accordingly, any necessary finishing machining operations after the welding of the skirt 104 and the crown 102 may be reduced in complexity, extent, and/or cost.

Where crown 102 and skirt 104 are welded together, a weld joint between the crown 102 and skirt 104 may be relaxed by a heat treatment after the welding process. Alternatively, a filler material, e.g., filler wire, may be used during the welding operation to generally reduce any need for heat treatment.

Turning again to FIG. 5A, at block 508 a cover plate 116 may be assembled to the piston assembly 100, thereby generally enclosing the cooling gallery 108. More specifically, the cover plate 116 may be assembled such that it is secured at a radially outer portion to the piston crown 102, and at a radially inner portion to a seating surface of the skirt 104.

Accordingly the piston assembly 100 and an exemplary method 500 of making the assembly generally allow for simplified manufacture of a lightweight piston assembly 100. Additionally, due to the flexibility in selection of materials, the relatively small gap between the skirt and crown that is enabled by the construction of a weld joint in the combustion bowl, and the resulting improved piston dynamics and frictional behavior the piston assembly 100 generally has better noise/vibration/harshness (NVH) characteristics. For example, reduced friction may result in a corresponding reduction in vibrations of the piston assembly 100 due to the reciprocal motion and sliding along engine bore surfaces. Additionally, the piston assembly may also be able to tolerate increased peak combustion pressures generally as a result of the rigidity of the piston assembly 100 and the additional flexibility in material selection. Additionally, manufacturing costs may be reduced due to the simplified forging and welding processes that may be used in some exemplary illustrations.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A method, comprising:

providing a piston crown blank defining a doughnut shape having a preformed central aperture;

forming from the piston crown blank a piston crown including a ring belt portion defining at least in part a cooling gallery;

receiving a piston skirt in a central opening of the crown such that the crown and skirt cooperate to form a continuous upper combustion bowl surface;

securing the skirt to the crown along a single circumferential interface region between the crown and skirt, the interface region including corresponding mating surfaces of the skirt and crown, the mating surfaces being oriented at an acute angle with respect to an axis of the skirt and the crown, the skirt and crown cooperating to define a radially outer gap between the skirt and the crown about a periphery of the piston crown; and installing a cover plate to enclose the cooling gallery, the cover plate forming a lower boundary of the cooling gallery;

wherein the corresponding mating surfaces meet near a base of the combustion bowl such that the crown defines a radially outer portion of the combustion bowl surface and the skirt defines a radially inner portion of the combustion bowl surface;

wherein securing the skirt to the crown is achieved by welding from inside the combustion bowl radially outward toward the radially outer gap such that weld splatter is reduced in the cooling gallery.

2. The method of claim 1, wherein the corresponding mating surfaces define the sole connection between the crown and skirt.

3. The method of claim 1, further comprising establishing welding the skirt to the crown as laser welding the skirt to the crown.

4. The method of claim 3, wherein laser welding the skirt to the crown includes directing a laser beam radially outward toward the corresponding mating surfaces.

5. The method of claim 4, wherein the corresponding mating surfaces cooperate to define a joint depth, the laser beam penetrating the crown and skirt along the corresponding mating surfaces to a beam depth less than the joint depth.

6. The method of claim 5, wherein the beam depth is approximately 1 millimeter less than the joint depth.

7. The method of claim 3, wherein directing the laser beam radially inward toward the corresponding mating surfaces includes directing the laser beam through the radially outer gap defined between the crown and the skirt.

8. The method of claim 1, wherein providing the piston crown blank includes one of casting and machining the piston crown blank.

9. A method, comprising:

providing a piston crown blank defining a doughnut shape having a preformed central aperture;

forming from the piston crown blank a piston crown including a ring belt portion defining at least in part a cooling gallery;

receiving a piston skirt in a central opening of the crown such that the crown and skirt cooperate to form a continuous upper combustion bowl surface;

directing a laser toward a single circumferential interface region between the crown and skirt, the interface region including corresponding mating surfaces of the skirt and crown, the mating surfaces being oriented at an acute angle with respect to an axis of the skirt and the crown, thereby welding the skirt to the crown along the corresponding mating surfaces, the skirt and crown cooperating to define a radially outer gap between the skirt and the crown about a periphery of the piston crown; and installing a cover plate to enclose the cooling gallery, the cover plate forming a lower boundary of the cooling gallery;

wherein the corresponding mating surfaces meet near a base of the combustion bowl such that the crown defines a radially outer portion of the combustion bowl surface and the skirt defines a radially inner portion of the combustion bowl surface;

wherein the laser is directed from inside the combustion bowl radially outward toward the radially outer gap such that weld splatter is reduced in the cooling gallery.

10. The method of claim 9, wherein the corresponding mating surfaces define the sole connection between the crown and skirt.

11. The method of claim 9, wherein welding the skirt to the crown includes directing the laser radially outward toward the corresponding mating surfaces.

12. A piston assembly, comprising:

a piston crown, including a ring belt portion defining at least in part a cooling gallery, the crown including a crown mating surface extending about a periphery of the crown;

a piston skirt received in a central opening of the crown, the skirt including a skirt mating surface extending about a periphery of the skirt, the crown and skirt mating surfaces included in a single circumferential interface region between the crown and skirt and oriented at an acute angle with respect to an axis of the skirt and the crown, the skirt secured to the crown by the interface region such that the crown and skirt cooperate to form a continuous upper combustion bowl surface, the skirt and crown cooperating to define a radially outer gap between the skirt and the crown about a periphery of the piston crown;

wherein the corresponding mating surfaces meet near a base of the combustion bowl such that the crown defines a radially outer portion of the combustion bowl surface and the skirt defines a radially inner portion of the combustion bowl surface, and such that the mating surfaces are able to be welded from inside the combustion bowl radially outward toward the radially outer gap to reduce weld splatter in the cooling gallery; and wherein the corresponding mating surfaces have a single slope to define the sole connection between the crown and skirt.

13. The piston assembly of claim 12, further comprising a cooling gallery cover plate forming a lower boundary of the cooling gallery, wherein the cooling gallery is generally enclosed by the crown and the cover plate.

14. The piston assembly of claim 12, wherein the combustion bowl surface is substantially smooth across the interface region.

15. The piston assembly of claim 12, wherein the ring belt portion is spaced apart from the skirt by the radially outer gap.

* * * * *